US006012200A

United States Patent [19]

Murphy et al.

[11] Patent Number: 6,012,200

[45] Date of Patent: Jan. 11, 2000

[54] UPRIGHT VACUUM CLEANER

[75] Inventors: John S. Murphy, Brook Park; Robert Matousek, Lakewood; Richard C. Farone, Wickliffe; David M. Brickner, Willoughby; Jeffrey M. Kalman, Cleveland; Craig M. Saunders, Rocky River; Michael F. Wright, Cuyahoga Falls, all of Ohio

[73] Assignee: Royal Appliance Mfg. Co., Cleveland, Ohio

[21] Appl. No.: 08/781,488

[22] Filed: Jan. 10, 1997

[51] Int. Cl.[7] ..... A47L 9/12

[52] U.S. Cl. ..... 15/347; 15/349; 15/352; 15/410

[58] Field of Search ..... 15/410, 352, 327.5, 15/349

[56] References Cited

U.S. PATENT DOCUMENTS

| | | | |
|---|---|---|---|
| D. 371,654 | 7/1996 | WoRwag . | |
| 1,670,715 | 5/1928 | Doherty . | |
| 1,746,246 | 2/1930 | Elworthy . | |
| 1,829,582 | 10/1931 | Carson . | |
| 2,037,668 | 4/1936 | Smith et al. . | |
| 2,145,723 | 1/1939 | Holm-Hansen . | |
| 2,709,273 | 5/1955 | Kelly et al. | 15/410 X |
| 3,193,992 | 7/1965 | Findley et al. | 15/410 X |
| 3,460,188 | 8/1969 | Boyd . | |
| 3,482,276 | 12/1969 | Fillery . | |
| 3,618,158 | 11/1971 | Worwag . | |
| 3,906,585 | 9/1975 | Mattsson . | |
| 4,334,337 | 6/1982 | Miller et al. | 15/410 X |
| 4,586,214 | 5/1986 | Berfield | 15/327.5 |
| 5,018,240 | 5/1991 | Holman . | |
| 5,349,752 | 9/1994 | Stirm | 15/349 X |
| 5,500,979 | 3/1996 | Worwag . | |
| 5,829,090 | 11/1998 | Melito et al. | 15/349 X |

FOREIGN PATENT DOCUMENTS 466226 5/1937 United Kingdom .

*Primary Examiner*—Chris K. Moore

*Attorney, Agent, or Firm*—Fay, Sharpe, Beall, Fagan, Minnich & McKee, LLP

[57] ABSTRACT

An upright vacuum cleaner includes a nozzle base (12) with at least one suction opening (60) formed therein. A rotatable brushroll (64) is positioned adjacent to the suction opening (60) for agitating a surface being cleaned. A suction source (54) is housed within the nozzle base (12). A dust cup assembly (70) is releasably connected to the nozzle base (12). The dust cup assembly (70) connects the suction source (54) and the suction opening (60) in fluid communication. A filter assembly (90) including a handle (101) is positioned between the dust cup assembly (70) and the suction source (54) to block the passage of dirt and dust to the suction source (54). A handle (10) is pivotally connected to the nozzle base (12) and includes an upper handle grip (22) including a hooked portion (24) for hanging the upright vacuum cleaner. First and second wings (74*a*, 74*b*) extend from opposite lateral sides of the dust cup cover (72) to facilitate the separation of the dust cup assembly (70) and the nozzle base (12). A power cord retainer (32) includes a stationary section (34) and a pivoting section (36) which is selectively opened and closed relative to the stationary section (34) to selectively define a cord retaining loop (38).

8 Claims, 9 Drawing Sheets

UPRIGHT VACUUM CLEANER

BACKGROUND OF THE INVENTION

The present invention relates to vacuum cleaners. More particularly, the present invention relates to an easily used and easily stored lightweight upright vacuum cleaner for suctioning dirt and debris from carpets and floors.

Upright vacuum cleaners are continually being improved and enhanced with larger, more powerful motors and with an assortment of cleaning accessories and attachments. As upright cleaners are enhanced in this manner, they correspondingly increase in size and weight. The height and the footprint of the nozzle base portion of the cleaner have become larger to accommodate the more powerful motors and, perhaps, some accessories. These enhanced upright cleaners are too heavy and occupy too much storage space to be owned by people dwelling in small apartments, trailers, dormitories, and similar locations with limited storage area. Their size also makes cleaning under beds and other furniture difficult. The handle of many such cleaners is connected to the top of the nozzle base, which undesirably increases the overall height of the nozzle base when the handle is reclined for cleaning under beds and the like. Often, the location of the filter bag and the design of the hinge interconnecting the handle portion to the nozzle base portion prevents the handle from being pivoted downward sufficiently far to approach the surface being cleaned as is required for cleaning under furniture. Furthermore, known upright cleaners are too heavy and do not provide an effective means for hanging storage. Rather, they must be stored on the floor of a closet or in the corner of a room.

Upright vacuum cleaners generally utilize large filter bags to capture the dirt and dust liberated from the subjacent surface being cleaned. These bags are either housed in or connected to the upper handle portion of the cleaner. When full, these bags must be disconnected from the cleaner, disposed of, and replaced. The operator of the cleaner must purchase replacement bags regularly. Furthermore, the bag changing operation is time consuming, and some people object to utilizing disposable filter bags. In addition to the space occupied by the filter bag and its cloth or plastic housing, as these bags fill with dirt, the upper portion of the cleaner becomes quite heavy making the vacuum cleaner unbalanced.

Another drawback associated with known upright vacuum cleaners is their lack of an easy to use and effective power cord storage mechanism. Some upright cleaners utilize a mechanism that retracts the power cord into the upper handle portion of the cleaner. Others utilize a pair of spaced hooks connected to the handle around which the cord is wound. The provision of a retractable cord adds complexity, weight, and expense to the vacuum cleaner. The spaced hooks are inconvenient, require the operator to bend over each time the cord is wound around or unwound from the hooks, and do not provide a mechanism for quick and secure short-term storage of the cord. The cord must either be loosely draped over the handle where it is insecure and becomes tangled, or the cord must be completely wrapped around the hooks each time one desires to store the cord.

While certain upright cleaners have been designed in an effort to overcome some of the foregoing deficiencies, they have not been successful. One known cleaner utilizes a dust cup in the nozzle base portion to collect dirt and dust in place of the filter bag. However, the dust cup is difficult to remove from the cleaner. In order to empty the contents of the dust cup, the operator must grasp the filter assembly with two hands. This can result in the spillage of the contents of the dust cup when it becomes separated from the filter assembly.

Accordingly, it is desirable to develop a new and improved upright vacuum cleaner which would overcome the foregoing deficiencies and others while providing better and more advantageous overall results.

SUMMARY OF THE INVENTION

According to the present invention, a new and improved upright vacuum cleaner is provided.

In accordance with a first aspect of the present invention an upright vacuum cleaner includes a nozzle base. At least one rear wheel is located adjacent a rear edge of the nozzle base and the at least one rear wheel is supported for rotation about an axis. A handle is pivotally connected to the nozzle base and is pivotable about an axis that is coincident with the axis about which the at least one rear wheel rotates.

In accordance with another aspect of the present invention, an upright vacuum cleaner includes a nozzle base with at least one suction opening formed therein. A rotatable brushroll is positioned adjacent the at least one suction opening for agitating a surface being cleaned. A suction source is housed within the nozzle base. A dust cup assembly is releasably housed in the nozzle base. The dust cup assembly connects the suction source and the at least one suction opening in fluid communication. A filter assembly is positioned between the dust cup assembly and the suction source to block the passage of dirt and dust to the suction source. A handle is pivotally connected to the nozzle base. The handle includes an upper handle grip including a hooked portion for hanging the upright vacuum cleaner.

In accordance with yet another aspect of the present invention, an upright vacuum cleaner includes a nozzle base with at least one suction opening formed therein. The nozzle base also includes a cover. A suction source is housed within the nozzle base. A handle is pivotally connected to the nozzle base. A dust cup assembly is releasably connected to the nozzle base and includes an inlet in fluid communication with the at least one suction opening of the nozzle base and an outlet in fluid communication with the suction source. The dust cup assembly defines a chamber for retaining dirt. First and second wings extend from opposite lateral sides of the dust cup assembly above the nozzle cover to facilitate the separation of the dust cup assembly and the nozzle base.

In accordance with another aspect of the present invention, an upright vacuum cleaner includes a nozzle base having at least one suction opening formed therein. A suction source is positioned in the nozzle base. A dust cup assembly is releasably connected to the nozzle base and defines a dirt and dust collecting chamber. An inlet to the chamber is in fluid communication with the at least one suction opening of the nozzle base and an outlet from the chamber is in fluid communication with the suction source. A filter assembly is releasably positioned in the outlet of the dust cup assembly and includes a filter frame frictionally engaged with the dust cup assembly. A rear surface of the filter frame includes a handle formed therein.

In accordance with yet another aspect of the present invention, an upright vacuum cleaner includes a nozzle base, a suction source positioned in the nozzle base, and a power cord. A handle is connected to the nozzle base and a power cord retainer is connected to the handle. The power cord retainer includes a stationary section and at least one pivotable section connected to the stationary section with a hinge. The at least one pivotable section is selectively positionable in one of a closed position and an open position relative to the stationary section. The stationary section and the at least one pivotable section define a substantially closed power cord retaining loop when the at least one pivotable section is in the closed position.

One advantage of the present invention is the provision of a new and improved vacuum cleaner.

Another advantage of the present invention is the provision of an upright vacuum cleaner that eliminates the need for filter bags.

Still another advantage of the present invention is the provision of an upright vacuum cleaner having a low profile nozzle base so that it can fit beneath furniture for effective cleaning.

Yet another advantage of the present invention is the provision of a lightweight upright vacuum cleaner that can be hung for storage.

A further advantage of the present invention is the provision of an upright vacuum cleaner having a removable dust cup located in a nozzle base and having an easy to remove and easy to replace filter assembly.

A still further advantage of the present invention is the provision of an upright vacuum cleaner with an easy to use power cord storage mechanism.

A yet further advantage of the present invention is the provision of an upright vacuum cleaner with two different power cord storage mechanisms.

An additional advantage of the present invention is the provision of an upright vacuum cleaner which has, in addition to a brushroll, a filter chamber and a motor and fan assembly housed in a nozzle base so that a handle of the vacuum cleaner does not serve as a housing, or even an attachment point, for either of these items.

Another advantage of the present invention is the provision of an upright vacuum cleaner having a handle that connects to the nozzle base of the cleaner along a rear axle of the nozzle base.

Still other benefits and advantages of the invention will become apparent to those skilled in the art upon reading and understanding the following detailed description.

BRIEF DESCRIPTION OF THE DRAWINGS

The invention may take form in certain components and structures, a preferred embodiment of which will be illustrated in the accompanying drawings wherein.

DETAILED DESCRIPTION OF THE PREFERRED EMBODIMENT

Figure 1:
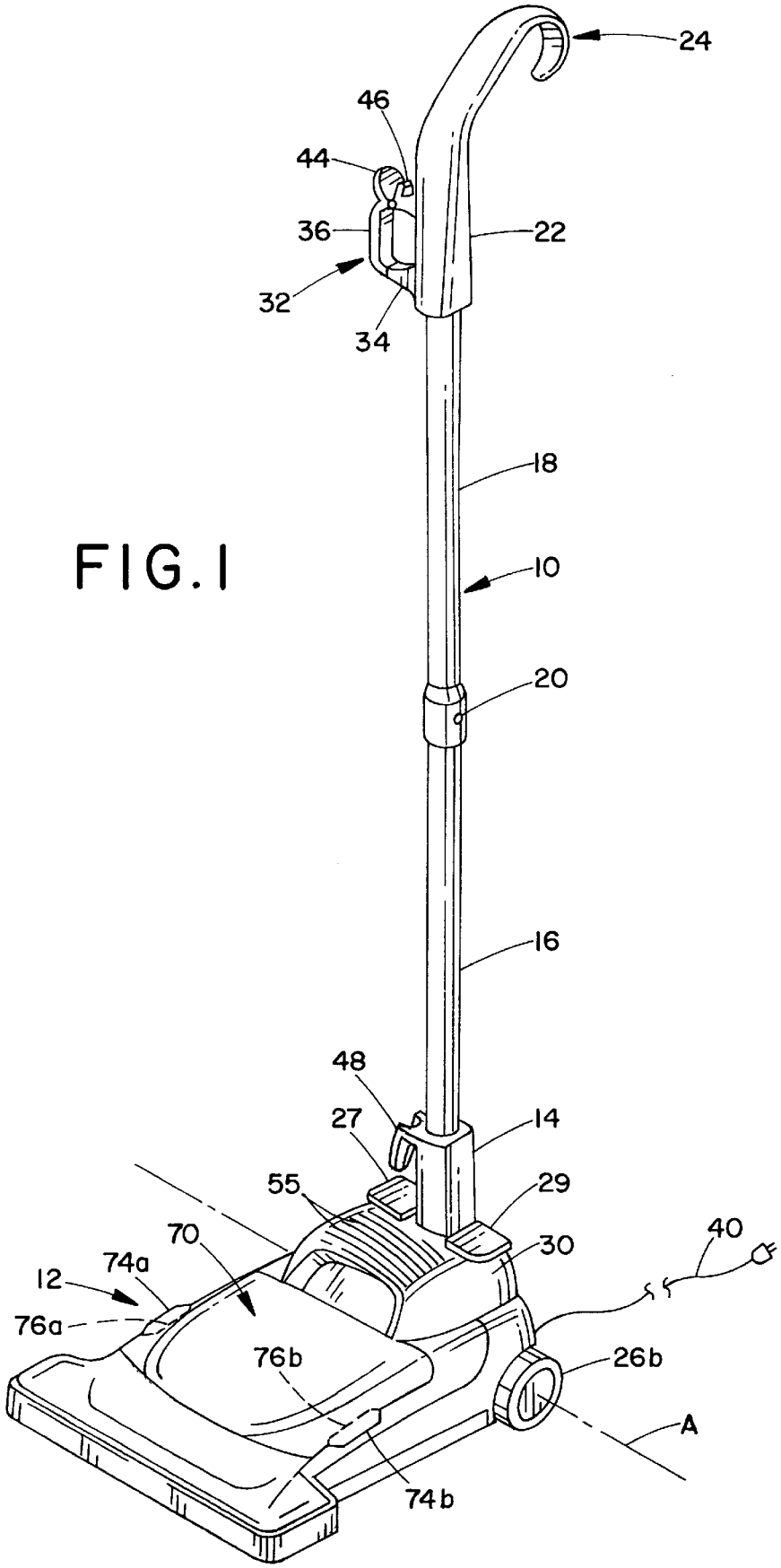
FIG. 1 is a perspective view of an upright vacuum cleaner in accordance with the present invention.
Figure 3:
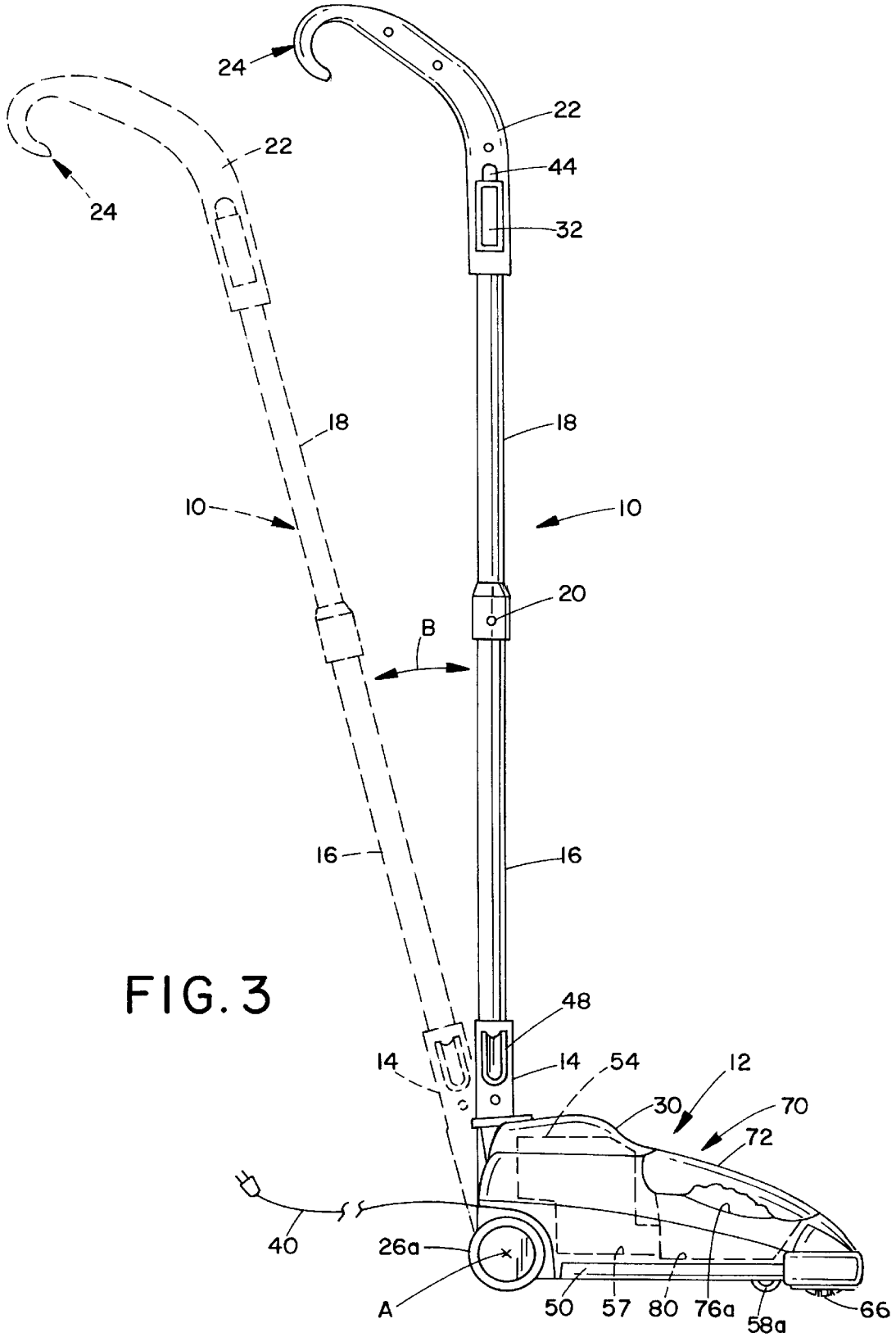
FIG. 3 is a side elevational view of the vacuum cleaner shown in FIG. 1, with the dust cup cover partially broken away to reveal a hand access indentation formed in the nozzle base cover.

Referring now to the drawings, wherein the showings are for purposes of illustrating a preferred embodiment of the invention only and not for purposes of limiting the same, FIG. 1 shows an upright vacuum cleaner in accordance with the present invention. The cleaner includes a handle 10 which is pivotally connected to a nozzle base 12. With reference also to FIG. 3, it can be seen that the handle 10 includes four main sections, each of which may be manufactured from a suitable conventional plastic, metal, or another known material.

A handle base 14 is connected to the nozzle base 12. The handle base 14 receives a lower handle section 16 and secures the lower handle section 16 to the nozzle base 14. An upper handle section 18 is connected to the lower handle section 16 with a suitable fastener 20 and a hand grip 22 is connected to the uppermost portion of the upper handle section 18. The hand grip 22 includes a curved or hooked portion 24 where the hand grip 22 curves downward and back upon itself. In addition to providing a location by which an operator can securely grasp the handle 10 of the cleaner during cleaning operations, the hooked portion 24 acts as a storage hook by which the cleaner may be hung for storage from an associated support member. For example, the hooked portion 24 of the hand grip 22 may be hung over a hook extending from a wall or door, or may be hung over a clothes hanging bar within a closet. When hung in this manner, the nozzle base 12 can be pivoted downward such that it forms almost a 180 degree angle with the handle 10.

With continued reference to FIG. 3, the handle 10 is pivotable about an axis A as is shown by the arrow B between an essentially vertical upright position and an inclined operative position as is shown in phantom. The axis A is coincident with the axis about which the rear wheels 26*a*, 26*b* (FIG. 1) rotate. As is shown in FIG. 8, a rear axle 28 rotatably supports the rear wheels 26*a*, 26*b* and also pivotally connects the handle base 14 to the nozzle base 12 about the axis A.

Figure 4:
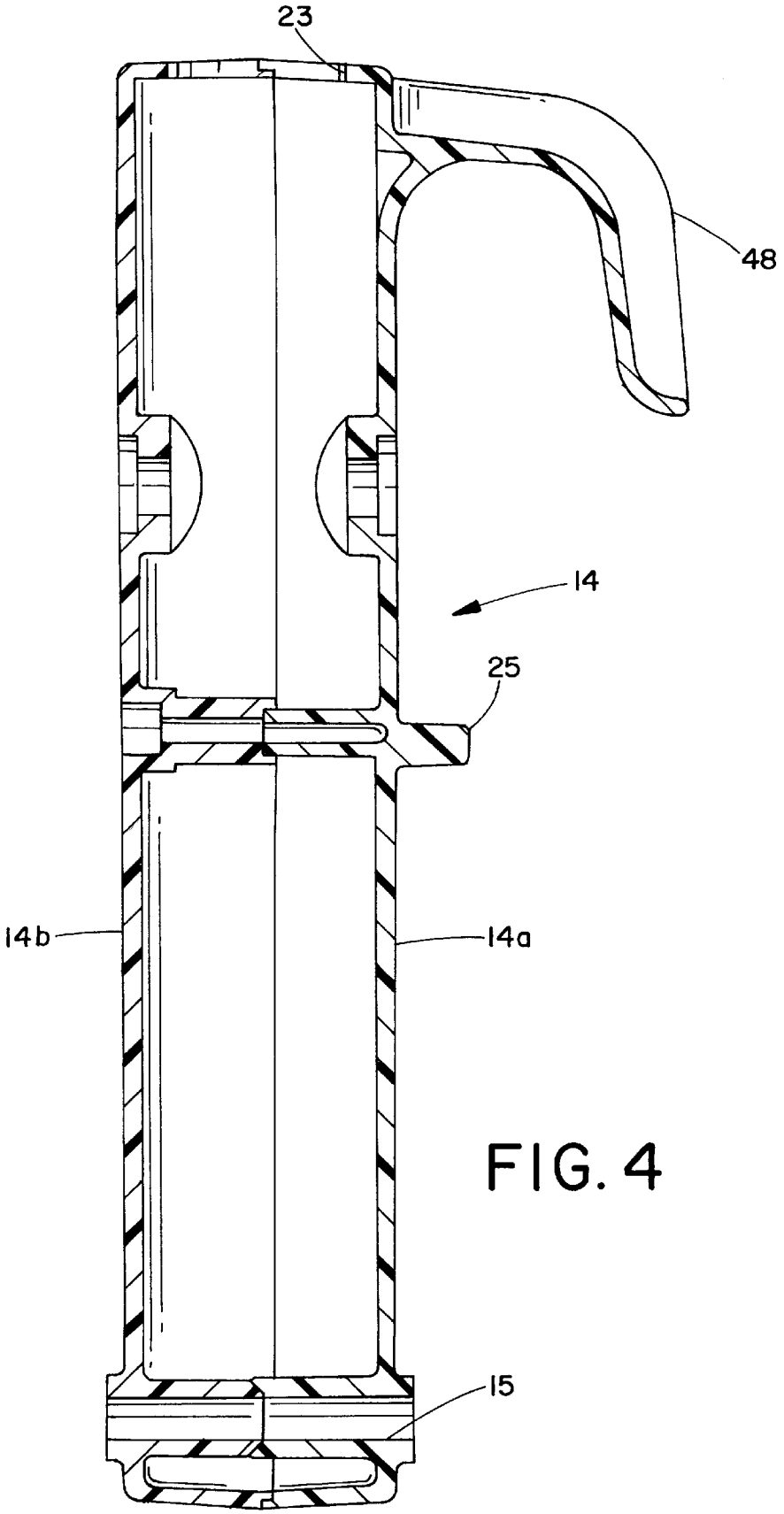
FIG. 4 is an enlarged cross-sectional view of a handle base of the vacuum cleaner of FIG. 1.
Figure 5:
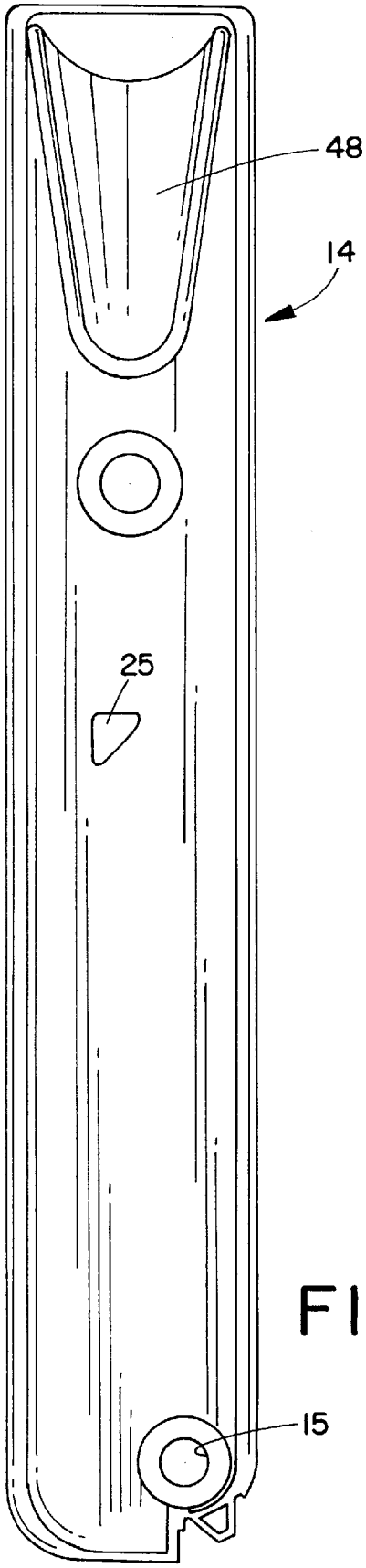
FIG. 5 is a side elevational view of the handle base of FIG. 4.
Figure 6:
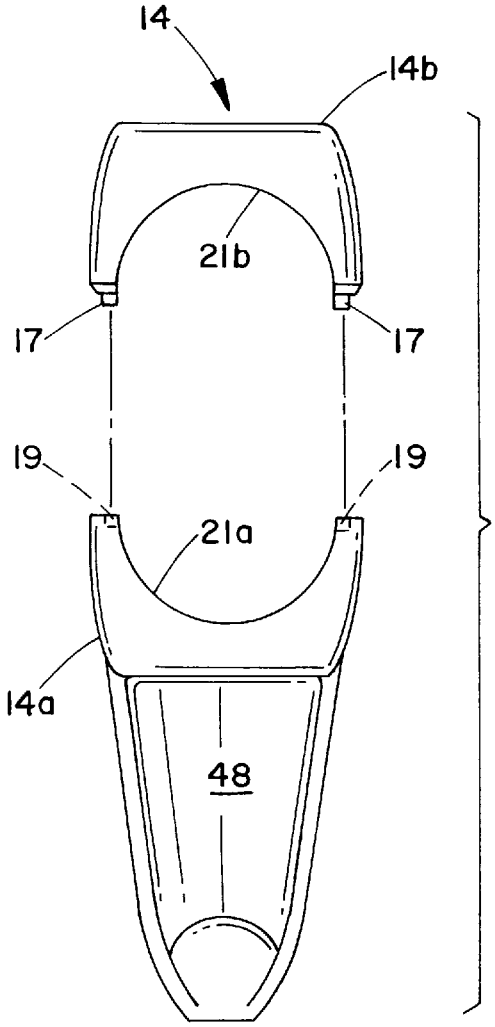
FIG. 6 is an exploded top plan view of the handle base of FIG. 4.

FIGS. 4–6 more clearly show the handle base 14 which is constructed of a first section 14*a* and a second section 14*b* which are secured together using an adhesive, one or more mechanical fasteners, or the equivalent. Those skilled in the art will recognize that the handle base 14 may also be formed as a one-piece construction. As is shown in FIG. 6, one of the first and second sections 14*a*, 14*b* includes projections 17 that mate with recesses 19 formed in the other of the sections 14*a*, 14*b*. Each section 14*a*, 14*b* includes a semicircular wall 21*a*, 21*b* (FIG. 6) and the two sections 14*a*, 14*b* thus form a bore 23 (FIG. 4) when they are interconnected. The bore 23 receives the lower handle section 16 therein. The lower handle section 16 is retained in the bore 23 using one or more suitable fasteners. FIGS. 4 and 5 show a transverse bore 15 provided through the lower portion of the handle base 14. The transverse bore 15 receives the rear axle 28 therethrough to pivotally connect the handle base 14 to the nozzle base 12.

This arrangement, wherein the axis A about which the handle 10 pivots is coincident with the axis about which the rear wheels 26*a*, 26*b* rotate is preferable in that it provides a more direct connection between the operator of the cleaner and the rear wheels 26*a*, 26*b*. Thus, when an operator desires to move the rear wheels 26*a*, 26*b* laterally, the force that the operator applies to the handle 10 is transmitted more directly to the wheels 26*a*, 26*b*, rather than indirectly through the nozzle base 12. Furthermore, the pivotable connection of the handle 10 to the nozzle base 12 as described ensures that a minimum portion of the handle 10 extends above the nozzle base 12 when the handle 10 is fully reclined relative to the nozzle base 12. Thus, when the operator desires to vacuum under a bed, for example, the handle 10 is fully reclined relative to the nozzle base 12, and only a minimum portion of the handle 10 extends above the nozzle base 12 to contact and interfere with the bed frame.

Figure 8:
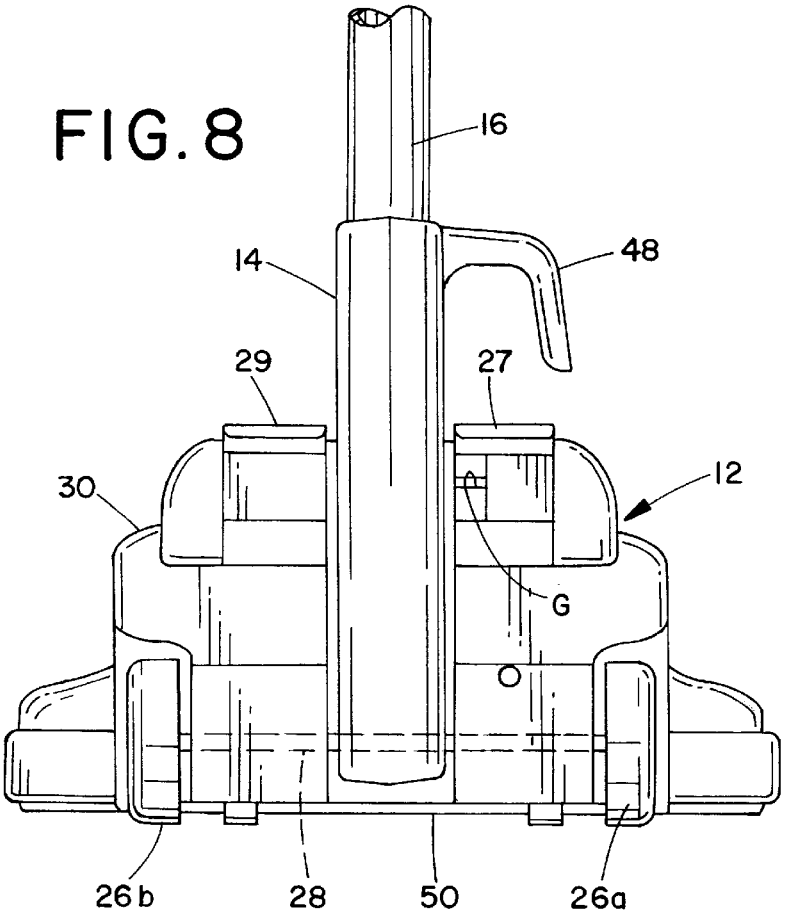
FIG. 8 is an enlarged partial rear elevational view of the vacuum cleaner shown in FIG. 1.

FIGS. 4 and 8 most clearly show the components for locking the handle 10 in its essentially vertical upright position. The handle base 14 includes a projection 25 extending therefrom. A pivotable release foot pedal 27 (FIG. 8) includes a slot or groove G formed therein. The groove G slidably receives the projection 25 when the handle 10 is in its upright position. When the pedal 27 is in its "locked" position, the projection 25 is restrained within the groove G. When an operator of the vacuum cleaner depresses the pedal 27, it pivots to its "release" position. When the pedal 27 is in its release position, the projection 25 is freely disengageable from the groove G, allowing the handle 10 to be reclined (FIG. 3).

With reference to FIGS. 1 and 8, the nozzle base 12 includes an on/off toggle foot pedal 29 for the motor of the vacuum cleaner. An operator of the vacuum cleaner depresses the pedal 29 to turn the vacuum cleaner on and off. Therefore, it is not necessary for the handle 10 to include an on/off switch or any of the associated electrical wiring.

Figure 2:
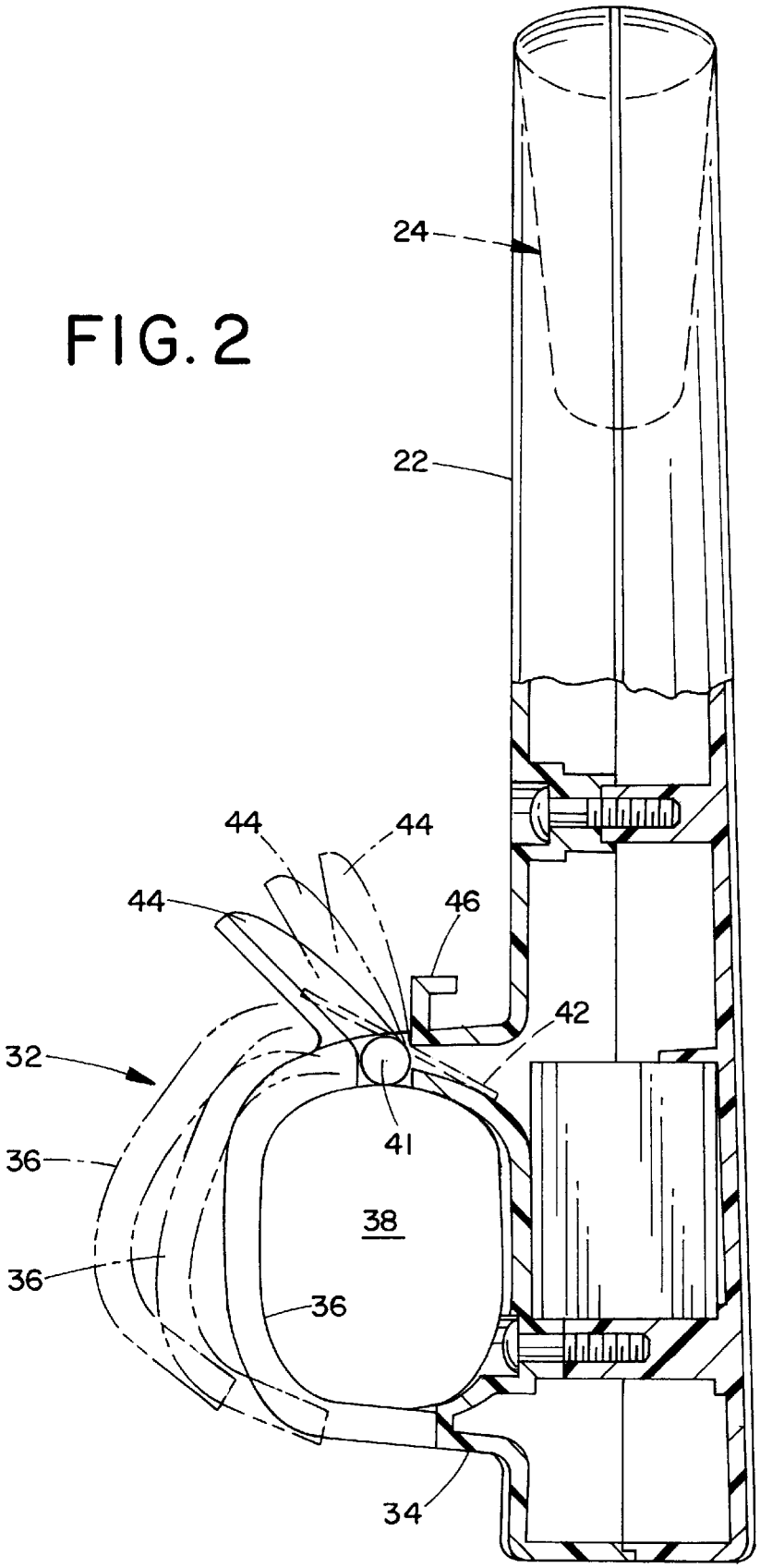
FIG. 2 is an enlarged front elevational view, partially broken away, of a handle grip of the vacuum cleaner of FIG. 1 showing a power cord retainer in accordance with the present invention.

With reference again to FIGS. 1–3, the handle 10 includes two different mechanisms for storage of a power cord 40. A cord retainer 32 is provided. The cord retainer 32 comprises a first stationary section 34, which is connected to the handle 10 or formed by the handle 10, itself. The cord retainer 32 also includes a second pivotable section 36 which, as is shown most clearly in FIG. 2, pivots around a hinge 41 between a closed position (shown in solid lines) and one or more open positions (shown in phantom). When in the closed position, the first and second section 34, 36 of the cord retainer 32 define a closed loop 38 which securely retains the power cord 40 after it has been coiled or otherwise gathered together. It can be seen in FIG. 2, that the cord retainer 32 includes a leaf spring 42 or another suitable biasing means which biases the second pivotable section 36 into its closed position adjacent to the first stationary section 34.

The cord retainer 32 also includes a tab 44 extending from the second section 36. An operator of the vacuum cleaner can use his or her thumb or other fingers to move the tab 44 clockwise toward the handle 101 thereby rotating a bottom end of the second section 36 away from the first section 34 to open the cord retainer 32. When the operator releases the tab 44, the spring 42 urges the cord retainer 32 counterclockwise into its closed position. The cord retainer 32 also includes a projection 46 which an operator of the vacuum cleaner can utilize to retain the power cord 40 during vacuuming operations, so that one-handed vacuuming is possible. The cord retainer 32 can also be used in conjunction with a lower cord retaining hook 48 of the handle 10 to retain the power cord 40. The lower hook 48 as shown herein is provided as a part of the handle base 14. In addition to its function described above, the tab 44 of the cord retainer 32 can function as an upper cord retaining hook. Thus, as an alternative to utilizing the cord retainer 32 alone to store the power cord 40, the power cord 40 can be wrapped around the lower hook 48 and around the cord retainer 32, with the tab 44 serving as an upper hook to retain the cord 40.

Figure 10:
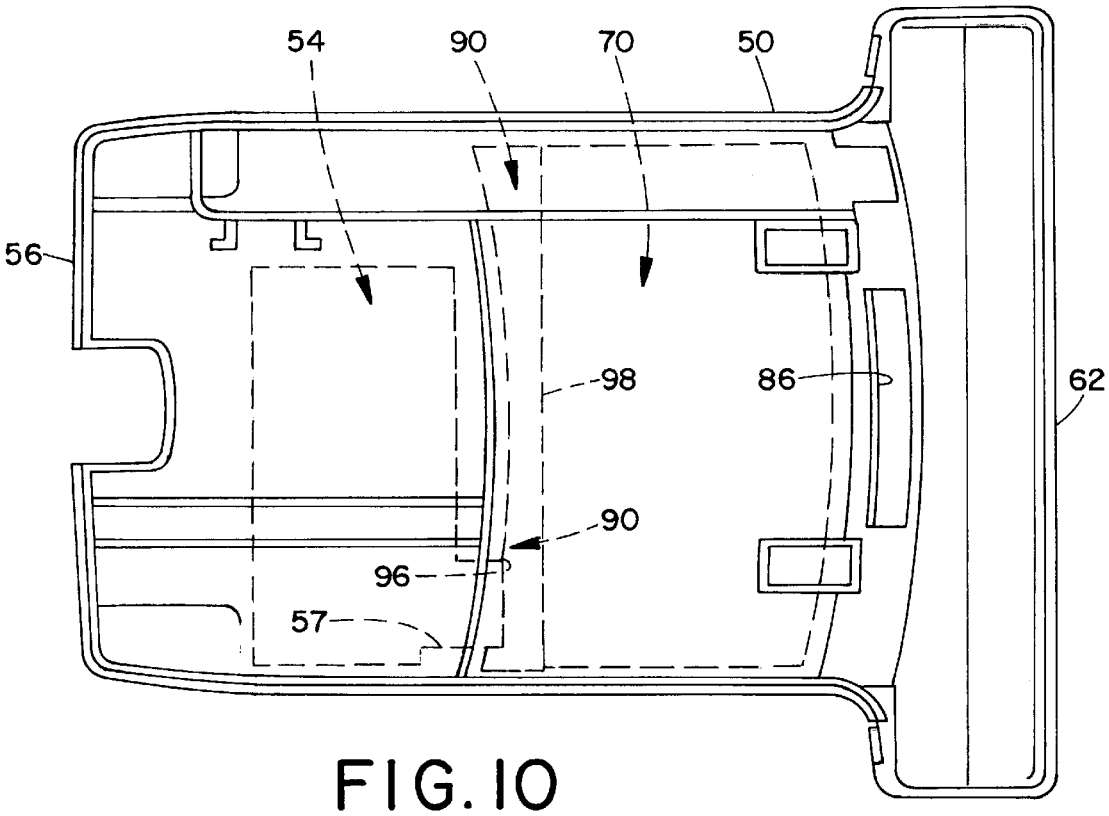
FIG. 10 is an enlarged top plan view of a nozzle base plate of the vacuum cleaner of FIG. 1.

Referring to FIG. 10, the nozzle base 12 of the vacuum cleaner includes a nozzle base mounting plate 50 which supports the various components of the nozzle base 12. A suction source such as an electric motor and fan assembly 54 is supported by the nozzle mounting plate 50 toward a rear edge 56 thereof. One suitable suction source 54 is a conventional three Ampere electric motor connected to a known fan assembly. It has been found that such a motor and fan assembly can generate up to 40 cubic feet per minute (c.f.m.) of airflow.

Figure 7:
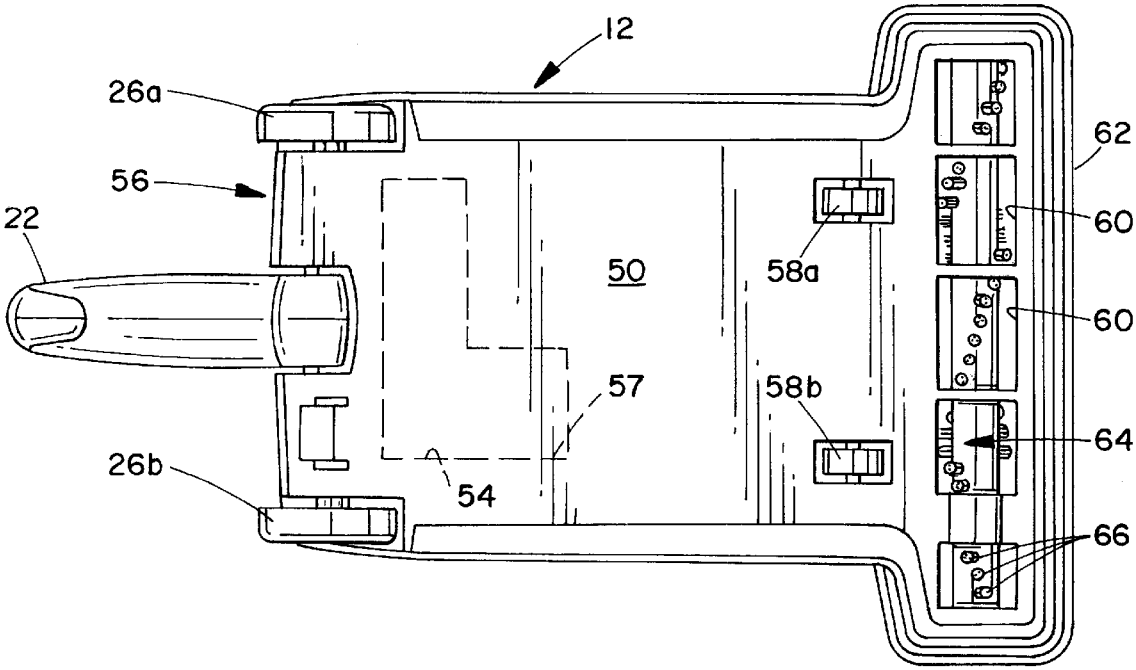
FIG. 7 is an enlarged bottom plan view of the vacuum cleaner shown in FIG. 1.

FIG. 7 shows that, in addition to the rear wheels 26*a*, 26*b*, the nozzle base 12 includes a pair of forward wheels 58*a*, 58*b*. One or more suction openings 60 are formed through the mounting plate 50 toward a front edge 62 thereof. These openings 60 are in fluid communication with the suction source 54. A brushroll 64 is rotatably mounted adjacent the one or more suction openings 60. The brushroll 64 includes a plurality of brush bristles 66 extending therefrom. The brushroll 64 is rotatably supported relative to the mounting plate 50 and is rotatably driven through a belt or other drive connection with the electric motor of the suction source 54. Upon rotation of the brushroll 64, the bristles 66 agitate and scrub the subjacent surface being cleaned, allowing the liberated dirt and dust particles to be more easily suctioned into the one or more suction openings 60

FIGS. 3 and 10 show most clearly the dust cup assembly 70 which is slidably and releasably received and housed in the nozzle base 12. The dust cup assembly 70 is retained in the nozzle base 12 with a friction fit. One or more detents (not shown) can also be utilized to provide a snap-fit between the dust cup assembly 70 and the nozzle base 12. It can be seen in FIG. 11 that the dust cup assembly 70 includes a gasket or seal 71. The seal 71 substantially encircles at least the front and rear sides of the periphery of the dust cup assembly 70. When the dust cup assembly 70 is received within the nozzle base 12, the seal 71 prevents unwanted airflow around the dust cup assembly 70 between the walls of the dust cup and the walls of the nozzle base 12.

Figure 9:
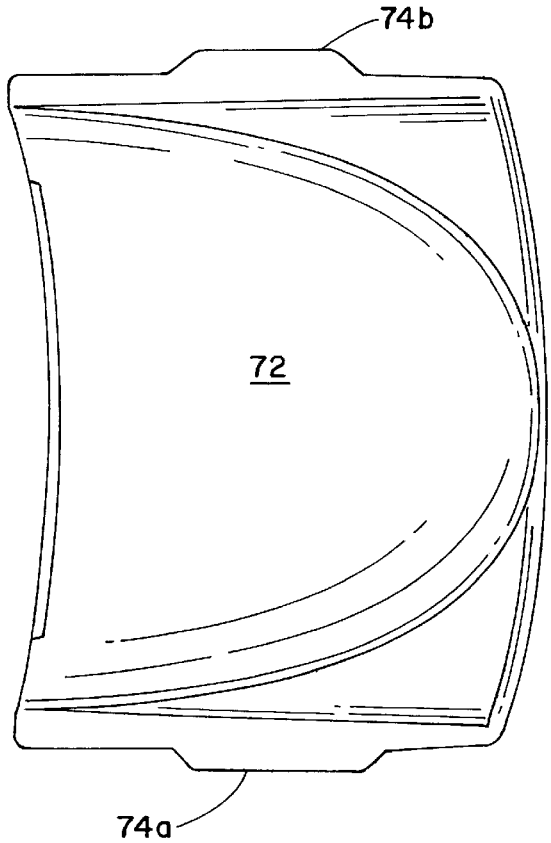
FIG. 9 is an enlarged top plan view of a dust cup cover of the vacuum cleaner of FIG. 1.

As is also shown in FIG. 9, the upper cover 72 of the dust cup assembly includes first and second wings 74*a*, 74*b* extending from opposite lateral sides thereof. The wings 74*a*, 74*b* are provided to facilitate the removal of the dust cup assembly 70 from its operative position within the nozzle base 12. The wings 74*a*, 74*b* allow an operator to more easily grasp the dust cup assembly 70 by the wings 74*a*, 74*b*, and pull the dust cup assembly 70 from the nozzle base 12. To further facilitate this removal process, as is shown in FIGS. 1 and 3, the cover 30 of the nozzle body 12 includes first and second hand access indentations 76*a*, 76*b* formed therein in alignment with the wings 74*a*, 74*b* to provide improved hand access to the wings, 74*a*, 74*b*, respectively.

Figure 11:
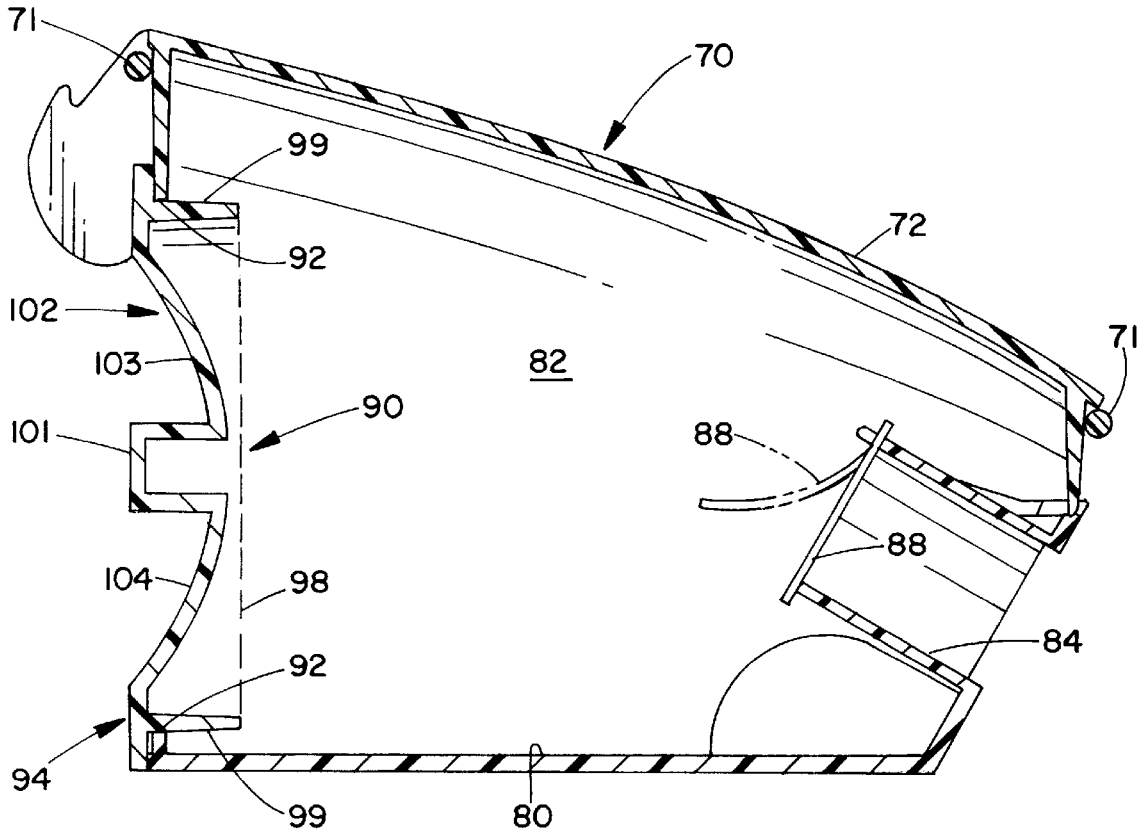
FIG. 11 is an enlarged cross-sectional view of a dust cup and filter assembly of the vacuum cleaner of FIG. 1.

FIGS. 3 and 11 show that the dust cup assembly 70 also includes a lower dirt and dust collecting section 80 to which the dust cup cover 72 is connected to thereby define a dirt and dust collecting chamber 82. The dust cup assembly 70 includes an inlet 84 to the chamber 82. The inlet 84 is in fluid communication with the one or more suction openings 60 formed in the mounting plate 50 through an aperture 86 (FIG. 10) formed through the mounting plate 50.

The inlet 84 to the chamber 82 preferably includes a one-way valve means such as a flapper member 88 made of rubber or another flexible material. When the suction source 54 is activated, the flapper 88 opens under the force of the suction as is shown in phantom, to allow dirt and dust to enter the chamber 82. When the suction source is turned off, or when the dust cup assembly 70 is removed from the nozzle body 12, the flapper 88 closes, thereby preventing the exit of dirt and dust from the chamber 82 through the inlet 84.

Referring again to FIGS. 10 and 11, the dust cup assembly 70 includes a filter assembly 90 releasably secured via a friction fit—to provide an air-tight seal—within an outlet opening 92 of the dust cup assembly 70 such that any air exiting the chamber 82 must pass through the filter assembly 90. When the dust cup assembly 70 is operatively positioned in the nozzle base 12, the chamber 82 thereof is in fluid communication with the suction source 54 through the filter assembly 90. Thus, those skilled in the art will recognize that, upon the activation of the suction source 54, air is suctioned into the one or more suction openings 60 formed in the nozzle base plate 50, through the aperture 86 in the base plate 50, and into the dust cup chamber 82 through its inlet 84. The dust and dirt are trapped in the chamber 82 while air passes through the filter assembly 90 and travels into the fan of the suction source 54. The suction source 54 exhausts the air through a plurality of vents 55 (FIG. 1) formed in the nozzle cover 30.

Figure 12:
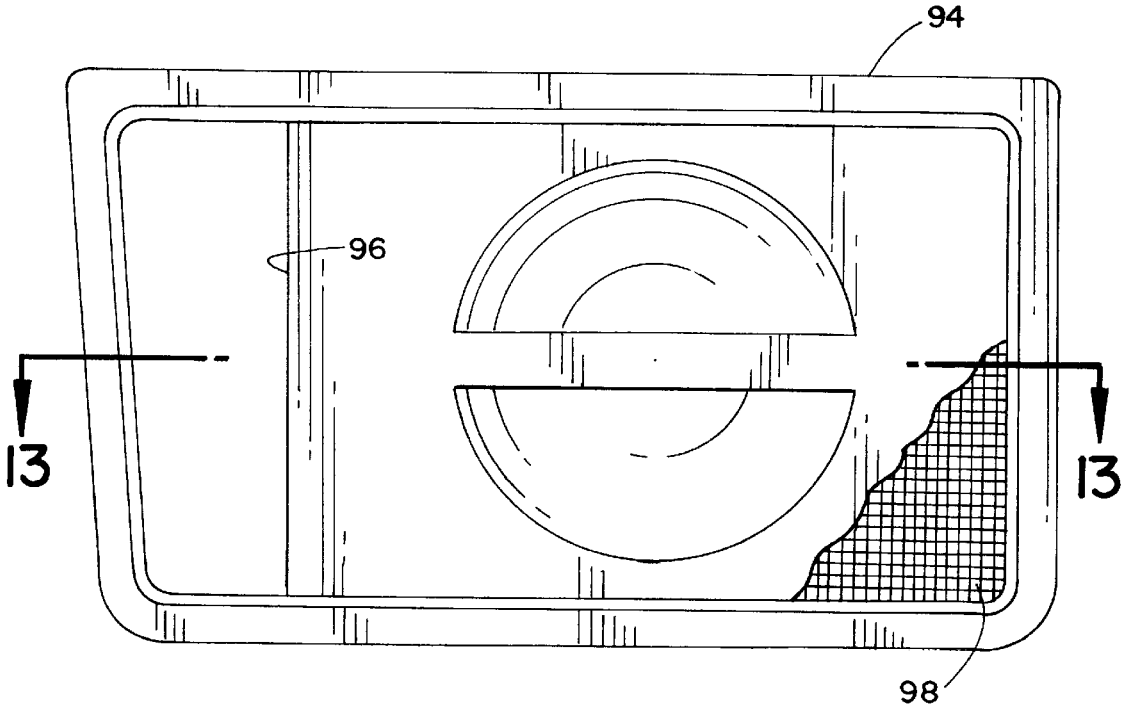
FIG. 12 is a front elevational view of a filter assembly of FIG. 11, with the filter media being broken away; and, FIG. 13 is a cross-sectional view along line 13—13 of FIG. 12.
Figure 13:
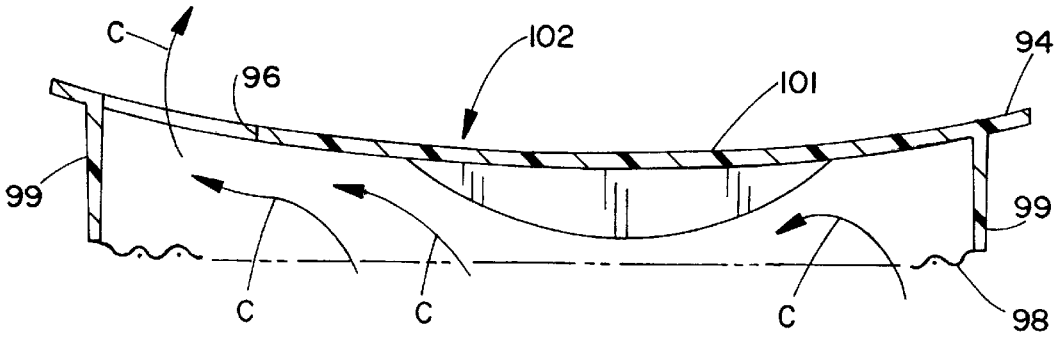

In FIGS. 11–13, it can be seen that the filter assembly 90 includes a frame member 94 which includes a aperture 96 formed therethrough to provide an outlet from the dust cup chamber 82. The aperture 96 provides fluid communication between a suction inlet 57 of the suction source 54 and the chamber 82 of the dust cup assembly 70. The gasket 71 surrounds the connection between the suction inlet 57 of the suction source 54 and the aperture 96 to prevent unwanted airflow into the suction source 54. Filter media 98, such as conventional pleated paper media or the like, is connected to a peripheral flange 99 extending from an inner wall 100 of the frame 94 using an adhesive or the like. The flange 99 acts as a frame to prevent the filter media 98 from moving in relation to the filter frame 94 under the force of the suction. As air is suctioned into the dust cup assembly 70, it carries with it dirt and dust extracted from the surface being cleaned.

With continuing reference to FIGS. 11 and 13, it can be seen that air suctioned from the chamber 82 through the aperture 96 must pass through the filter media 98, as indicated by the arrows C. The filter media 98 filters the dirt and dust from the air such that clean air passes through the suction source 54 and is exhausted through the vents 55. In this manner, the vacuum cleaner of the present invention constitutes a "clean air" system.

Over time, the chamber 82 of the dust cup assembly 70 will become full of dirt and debris. The cover member 72 of the dust cup assembly may be manufactured from a clear or "see through" plastic so that an operator of the cleaner may easily determine when the chamber 82 is due to be emptied. To empty the chamber 82, the operator removes the dust cup assembly 70 from the nozzle base 12 by grasping the wings 74*a*, 74*b* of the dust cup cover 72 and pulling upward.

Referring now to FIG. 11, the filter assembly 90 is frictionally engaged in the outlet 92 of the dust cup assembly 70. The filter frame 94 includes a handle 101 formed on a rear surface or wall 102 thereof. As shown herein, first and second indentations 103, 104 are formed in the rear wall 102 and the handle 101 is formed therebetween. The indentations 103, 104 provide convenient hand access space. The formation of the handle 101 in this manner, with the handle 101 being recessed, provides a smooth rear wall 102 to the filter assembly 90. An operator can separate the filter assembly 90 from the dust cup assembly 70 by grasping the handle member 101 with one hand and the dust cup assembly 70 in the other hand. The filter assembly 90 and the dust cup assembly 70 can then be pulled apart, without requiring the operator to grasp the filter assembly 90 with two hands. Instead, the operator is able to use one hand to hold the dust cup assembly 70 and the other to grasp the handle 101 of the filter assembly 90. Depending upon usage conditions, the filter assembly 90 can be cleaned and/or replaced when it becomes clogged with dirt and dust.

The invention has been described with reference to a preferred embodiment. Obviously, modifications and alterations will occur to others upon reading and understanding the preceding specification. It is intended that the invention be construed as including all such modifications and alterations insofar as they come within the scope of the appended claims or the equivalents thereof.

Having thus described the preferred embodiment, the invention is now claimed to be:

1. An upright vacuum cleaner comprising:

a nozzle base including at least one suction opening formed therein:

a rotatable brushroll positioned adjacent said at least one suction opening for agitating a surface being cleaned;

a suction source housed within said nozzle base a dust cup assembly housed in said nozzle base, said dust cup assembly connecting said suction source and said at least one suction opening in fluid communication;

a filter assembly separate from said dust cup assembly and positioned between said dust cup assembly and said suction source to block the passage of dirt and dust to said suction source; and, a handle pivotally connected to said nozzle base, said handle comprising an upper handle grip including a hooked portion for hanging said upright vacuum cleaner.

2. An upright vacuum cleaner as set forth in claim 1 wherein said dust cup assembly includes a cover having first and second wings respectively extending from opposite lateral sides thereof by which an operator of said upright cleaner grasps said dust cup assembly.

3. An upright vacuum cleaner as set forth in claim 2 wherein said nozzle base comprises a nozzle base cover, said cover comprising first and second hand access indentations formed therein and in alignment with said first and second wings, respectively.

4. An upright vacuum cleaner as set forth in claim 1 wherein said filter assembly is positioned in an outlet of said dust cup assembly and comprises a rear surface including a handle for one-handed separation of said filter assembly from said dust cup assembly.

5. An upright vacuum cleaner as set forth in claim 4 wherein said filter assembly is retained in said outlet of said dust cup assembly by a friction fit.

6. An upright vacuum cleaner as set forth in claim 4 wherein said rear surface of said filter assembly includes at least two indentations formed therein to provide said handle.

7. An upright vacuum cleaner comprising:

a nozzle base having at least one suction opening formed therein;

a suction source positioned in said nozzle base;

a dust cup assembly releasably connected to said nozzle base, said dust cup assembly defining a dirt and dust collecting chamber, said dust cup assembly comprising an inlet to said chamber in fluid communication with said at least one suction opening of said nozzle base and an outlet from said chamber in fluid communication with said suction source; and, a filter assembly releasably positioned in said outlet of said dust cup assembly, said filter assembly comprising a filter frame frictionally engaged with said dust cup assembly, said frame having a rear surface including a handle formed therein.

8. An upright vacuum cleaner as set forth in claim 7 further comprising a one-way valve selectively blocking said inlet of said dust cup assembly.

* * * * *